US006505993B1

(12) United States Patent
Diem

(10) Patent No.: US 6,505,993 B1
(45) Date of Patent: Jan. 14, 2003

(54) METHOD AND DEVICE FOR BRAKING VEHICLES

(76) Inventor: Reinhard Diem, Wilhelmstr. 62, Herrenberg D71083 (DE)

( * ) Notice: Subject to any disclaimer, the term of this patent is extended or adjusted under 35 U.S.C. 154(b) by 0 days.

(21) Appl. No.: 09/619,168

(22) Filed: Jul. 19, 2000

(30) Foreign Application Priority Data

Jul. 27, 1999 (EP) ..... 99114337

(51) Int. Cl.[7] ..... E01F 13/04

(52) U.S. Cl. ..... 404/6; 404/10; 256/13.1; 472/85

(58) Field of Search ..... 404/6, 7, 9, 10; 256/1, 13.1; 472/85, 88, 89; 405/284, 262

(56) References Cited

U.S. PATENT DOCUMENTS

| | | | | | |
|---|---|---|---|---|---|
| 3,951,384 | A | | 4/1976 | Hildreth, Jr. | |
| 4,288,061 | A | * | 9/1981 | Moreau | 256/13.1 |
| 4,785,577 | A | * | 11/1988 | Lederbauer | 256/13.1 |
| 5,013,509 | A | * | 5/1991 | Kiselewski | 264/229 |
| 5,056,961 | A | * | 10/1991 | McMeans et al. | 405/284 |
| 5,370,475 | A | * | 12/1994 | LeBlanc | 405/21 |
| 5,378,088 | A | * | 1/1995 | Foehrkolb | 405/284 |
| 5,480,255 | A | | 1/1996 | Bernaquez et al. | |
| 5,549,279 | A | * | 8/1996 | Aszkenas | 404/6 |
| 5,568,913 | A | * | 10/1996 | Nagler | 404/6 |
| 5,645,368 | A | * | 7/1997 | Yunick | 404/6 |
| 5,645,371 | A | * | 7/1997 | Marzullo | 405/33 |

FOREIGN PATENT DOCUMENTS

| | | |
|---|---|---|
| CH | 372 443 | 10/1983 |
| DE | 33 08 651 | 9/1984 |
| DE | 44 18 554 | 8/1995 |
| DE | 196 46 749 | 5/1998 |

* cited by examiner

*Primary Examiner*—Robert E. Pezzuto
*Assistant Examiner*—Alexandra K. Pechhold
(74) *Attorney, Agent, or Firm*—Bachman & LaPointe, P.C.

(57) ABSTRACT

A method and a device for braking vehicles, in particular race car vehicles at the edge of a racetrack, whereby an elastic, safety wall consisting of individual elements linked together movably like a chain and extending far beyond the critical location is arranged in a clearance adjacent to the critical location of the racetrack. A vehicle coming off the racetrack and colliding with the safety wall is braked by the elastic movement of the safety wall with the vehicle. This inexpensive method of manufacturing a safe safety wall guarantees linear and soft deceleration of a vehicle, greatly improving the safety of the race car drivers.

21 Claims, 2 Drawing Sheets

METHOD AND DEVICE FOR BRAKING VEHICLES

FIELD OF THE INVENTION

The present invention relates to a method and a device for braking vehicles, in particular racing vehicles at the edge of a racetrack.

It is customary when racing vehicles to provide devices that can brake the vehicles or absorb their impact at critical locations where there is a risk of the race cars departing from the racetrack. To do so, at a critical curve at the edge of the racetrack, a gravel bed, for example, is provided, followed by a wall of tires consisting of several rows of stacked tires. However, these measures are not sufficient to reliably ensure that in the event of a brake failure, for example, the vehicle will be adequately braked because it still strikes the wall of tires at a high speed and the driver may still suffer considerable injuries due to the stable concrete wall behind the tires.

BACKGROUND OF THE INVENTION

German Patent Application No. 4,418,554 A1 describes a device for securing hazardous areas of a racetrack, where movable barriers are provided to absorb and dissipate the kinetic energy of a vehicle that departs from the track. The barrier is made of flexible, interconnected elements which are flexibly connected to the ground in a form-fitting manner. To do so, rails are driven into the ground so that tires arranged perpendicularly, i.e., with the tread down, can move in them. Since the barrier is arranged at a curve, the running rails are not arranged in parallel in the ground, but instead they are spread apart. Therefore, the tires are connected by an elastic band to be able to absorb the spreading effect when struck by a vehicle. The two ends of the barriers are fixedly anchored by a flexible band and thus allow only expansion of the barrier. Due to such a design, the kinetic energy is converted into energy of tension, so that a catapulting effect can be expected at the end of the running rails. With a reverse movement, there is a risk of jamming. When a vehicle strikes the barrier, only one running rail, namely the one in the direction of travel, can be loaded properly, while the others are loaded at an inclination, ant thus the elastic band can be stressed only in a partial range. Thus, the kinetic energy of the vehicle must be absorbed by a relatively small number of elastic bands. This causes an enormous lack of safety. On the whole, the device disclosed here presents an impractical solution from the standpoint of safety, assembly and cost.

German Patent Application No. 4,418,554 A1 describes a safety device for vehicle borders for use in motorcycle racing, where the stacks of horizontal tires are used to reduce the frontal impact against a barrier, divert it and prevent the vehicle from being stuck on the barrier. The tire stack is therefore provided with a crash barrier of plastic tubing and attached to slightly curved concrete barriers. This solution is similar to that already discussed above and the tire stack wall customary in the past and it is not suitable for braking a vehicle traveling at a high speed.

Austrian Patent 372,443 B describes a noise abatement wall consisting of stacks of tires that can be planted with greenery. Two rows, one above the other, are connected by screws, and any unwanted movement of the noise abatement wall is prevented by perpendicular iron rods or tubes driven into the ground. This proposal for a noise abatement wall is not suitable for use as a device for braking vehicles in racing.

German Patent Application 3,308,651 A1 describes a network of tire-like bodies for which used tires in whole form or preferably in chopped form can be used. This network serves as a fence for protecting people, animals and objects. Posts with the network stretched between them are provided. This network is anchored rigidly in the ground and its effect should be inferior to that of the tire stacks described above with regard to safety for racing.

U.S. Pat. No. 5,645,368 describes a barrier of two rows of barrier modules of tire stacks arranged horizontally one above the other with an offset, connected by iron clamps between a base plate and a cover plate. The base plate has the advantage that these barrier modules for racing can easily be arranged at the respective locations where there is a risk for the race car drivers, and they can easily be moved by the impact. This barrier is also used to mark the course of the racetrack.

U.S. Pat. No. 3,951,384 discloses a formable absorption device consisting of stacks of tires connected by bands, anchored to the bottom and stacked on top of each other. To increase the absorption capacity, the inside of the tires is filled with empty, fragile containers such as plastic bottles or metal cans. These tire stacks are positioned in front of a wall.

U.S. Pat. No. 5,480,255 also describes a wall of tires stacked over one another with an offset in essentially two rows, with the interspaces filled with sand to function as a crash wall for speedways. The tires themselves can also be connected to one another. This crash wall is also fixedly anchored in the ground and resembles the other options described above.

The situation is similar with U.S. Pat. No. 5,056,961, where tires are again used to construct walls by stacking them above one another and connecting them to one another.

International Patent WO 98/06904 A also describes an essentially known system for arranging stacks of tires to protect the race car driver from obstacles such as trees, posts, bridge pillars, walls or the like. Here again, the individual tires are linked together by bands and are secured to the ground or other suitable locations.

As practice has shown, none of these measures are suitable for braking a vehicle traveling into the tire wall at a high speed without causing severe damage to the vehicle and a high risk of injury to the driver.

SUMMARY OF THE INVENTION

Therefore, the object of the present invention is to propose a method that will permit reliable braking of the vehicles without greatly endangering the vehicle or the driver.

This object is achieved according to this invention by a method and by a safety wall having the features described hereinbelow.

According to this invention, the vehicle is braked by arranging an elastic, chain-like safety wall consisting of individual elements linked together movably at a clearance adjacent to the racetrack, and a vehicle leaving the racetrack and colliding with the safety wall is braked due to the elastic movement of the safety wall. Due to the arrangement of a free-standing safety wall consisting of individual elements linked together so that they can still move, without being anchored in the ground and with sufficient clearance behind the vehicle, a vehicle penetrating into the safety wall will entrain the wall and thus be braked by it because of the mass of the safety wall. It has surprisingly been found that the vehicle is then braked linearly to a standstill, so that no injury to the driver need be expected. Depending on the design, damping in addition to friction or instead of friction can occur due to damping elements arranged at the end of the safety wall and fixedly anchored there, permitting free movement of the safety wall as such but also damping its motion until it stops. To minimize the loads in impact of a vehicle with the safety wall, the inherent weight of the individual elements should be minimized, and the individual elements must also be elastic. This greatly reduces the intensity of the impact. According to a preferred embodiment, passenger vehicle tires are used as these elements, because they have the required properties and they are also available in abundance.

According to the safety wall designed according to the present invention, the safety wall has elastic, movable safety wall elements that are linked together like a chain and preferably have a total height greater than the height of the race car vehicle. The individual safety wall elements, preferably automobile tires, may be arranged as individual stacks of tires and linked together so they can still move. According to a preferred embodiment, the safety wall elements are stacked in an intermeshed arrangement and are movably connected to one another at the points of contact, because the number of safety wall elements and the inherent weight of the individual elements can be kept as low as possible in the area of a possible impact through this staggered arrangement.

On the whole, a sufficient weight on the order of the weight of the race car vehicle is achieved due to the length of the safety wall, which extends far beyond the critical location where the vehicle could leave the track, and this weight of the safety wall is sufficient to reliably brake a vehicle which runs off the track and collides with the safety wall.

To prevent the vehicle from rising above the safety wall or passing beneath it, a final band which connects all the stacks is arranged on the lowest elements near the bottom, so that when a race car vehicle collides with the safety wall, its front part passes over this band and thus reliably prevents the tire wall from lifting up in the remaining course of the braking process. In addition, the ends of the safety wall are advantageously connected to a fixed anchor, preferably being anchored to the ground, in order to prevent a whipping effect where the ends whip against one another due to the movement.

The individual safety wall elements can also be linked together by cords that have sufficient tensile strength to withstand the respective loads or by other suitable connecting means.

The present invention thus permits an inexpensive design of a safety wall by using available objects, resulting in a linear and soft retardation of the vehicle at the same time. This makes a considerable contribution toward the safety of the race car driver.

BRIEF DESCRIPTION OF THE DRAWINGS

The invention is described in greater detail below on the basis of an embodiment. The figures show.

DETAILED DESCRIPTION OF THE PREFERRED EMBODIMENTS

Figure 1:
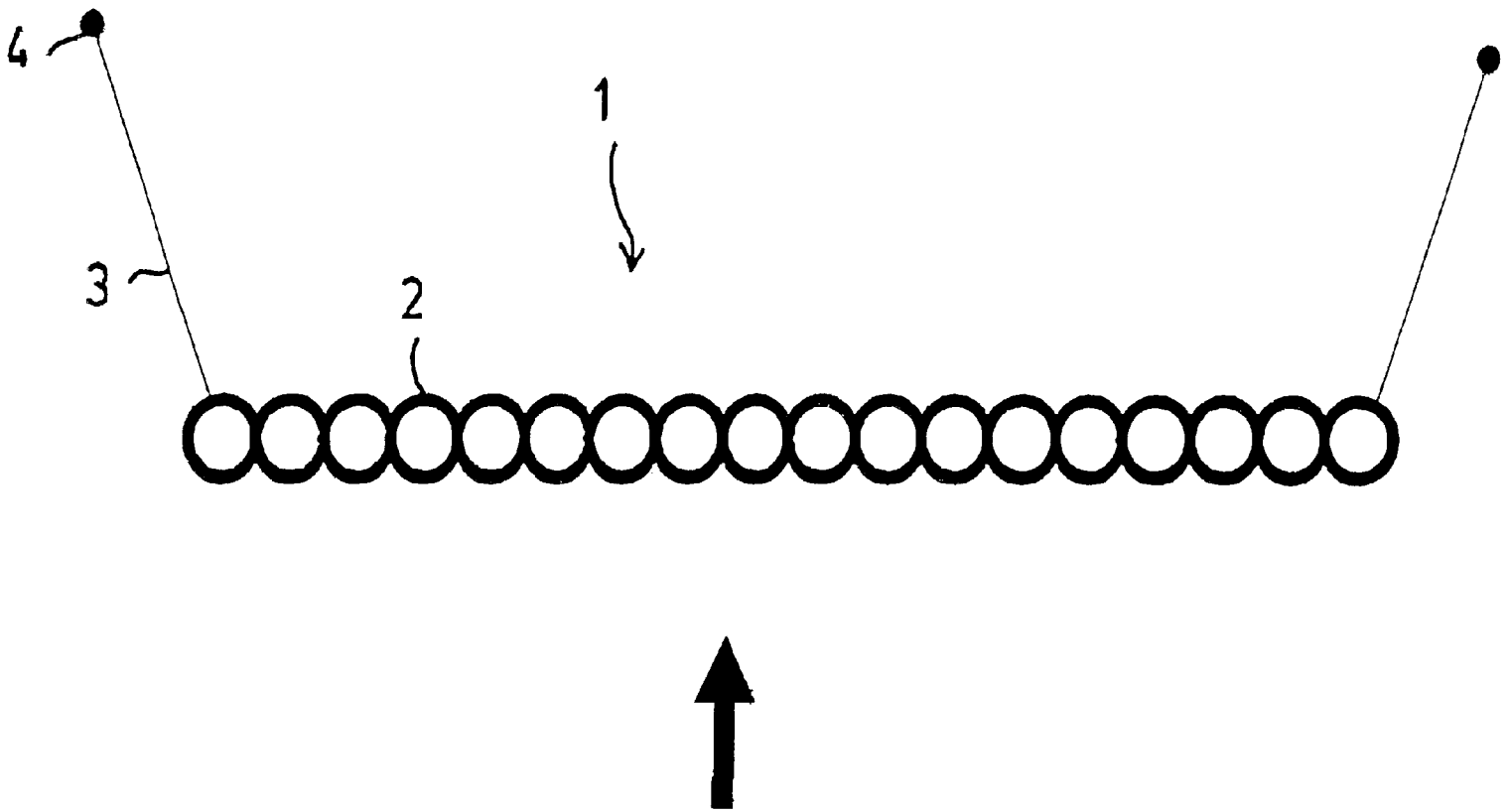
FIG. 1 a top view of a safety wall as a flexible wall of tires.

FIG. 1 shows a safety wall 1 made of individual automobile tires 2 which are linked together and secured at one end by a securing line 3 on a stationary ground anchor 4. A vehicle colliding with the wall in the direction of the arrow causes a displacement of the flexible tire wall as a safety wall and continuously brakes the vehicle colliding with it. The length of such a safety wall 1 must be sufficient to have a suitable total mass, which should correspond approximately to the mass of the vehicle colliding with it, so that the kinetic energy of the vehicle can be dissipated. On the other hand, the safety wall must not be too long, because otherwise the safety wall cannot move with the vehicle enough and then the vehicle deceleration would become too great.

Figure 2:
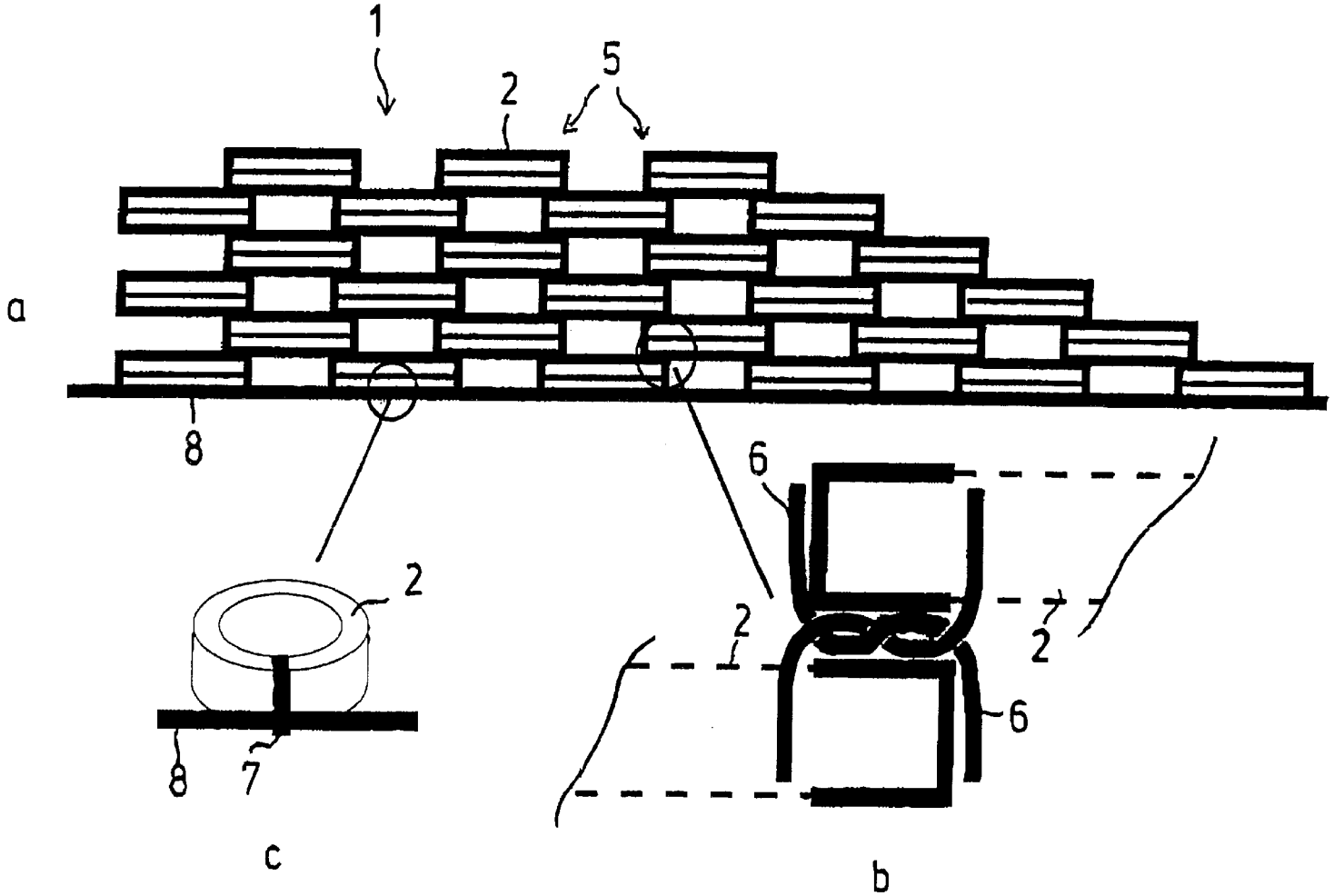
FIG. 2 a side view of a safety wall in FIG. 2*a* with an enlarged diagram of the individual safety wall elements in FIG. 2*c* their connection in FIG. 2*b*.

FIG. 2 shows a safety wall according to FIG. 1 in a side view in FIG. 2*a*. The safety wall consists of individual stacks of tires 5 arranged with an offset, as illustrated in the figure, and connected in a flexible manner.

FIG. 2*b* shows an enlarged diagram of the flexible connection between two automobile tires 2 by means of a band 6 which permits a rotational movement of the individual tires relative to one another, as is the case with a chain. The bands used may be suitable bands having an appropriate tensile force, such as the straps for blinds or the like. Essentially, it is also possible to connect the individual tires by means of a continuous bar, although this is more expensive.

FIG. 2*c* shows an enlarged diagram of an automobile tire 2 of the lower position, secured to an end band 8 by an additional band 7, so that all the tires in the lower layer are linked together to prevent the wall of tires from lifting up.

The length of such a safety wall should be at least twenty meters, but safety walls with a length of thirty to forty meters may also be used, depending on the application. The height of the stack of tires at the center of the safety wall corresponds to the height of five to six tires generally used, where this height also depends on the weight of the race car vehicle. When racing trucks, a greater height and a greater length of the wall of tires accordingly are necessary to achieve the desired weight and mass.

What is claimed is:

1. A method of braking vehicles,in particular race car vehicles at the edge of a racetrack, which comprises: movably linking together in a chain-like manner an elastic, one-piece safety wall consisting essentially of individual elastic elements, wherein said safety wall extends beyond a critical location of the racetrack and is arranged with clearance adjacent to the critical location of the racetrack; wherein a vehicle that leaves the racetrack and collides with the safety wall is braked in a linear manner due to the chain-like mobility of the safety wall and the acceleration forces relayed from the safety wall elements at the point of contact of the vehicle with the adjacent safety wall elements over the entire length of the one-piece safety wall, including providing horizontally stacked tires as the safety wall elements; and wherein the individual elements of the safety wall include end portions thereof and central portion thereof, and connecting the individual elements to each other adjacent the end portions thereof, contacting each other adjacent the end portions thereof and providing the central portions thereof free from contact with each other.

2. A method according to claim 1, including providing a band connecting bottom elements to each other near the ground.

3. A method according to claim 1, including attaching the safety wall to fixed anchors by lines provided at the ends of the safety wall on the sides thereof facing away from the racetrack.

4. A method according to claim 1, wherein the safety wall has ends thereof, and including also braking the vehicle because of shock absorbing elements arranged at the ends of the safety wall.

5. A method according to claim 1, including stacking individual elements in an intermeshed manner, movably connected to each other at points of contact therebetween.

6. A method according to claim 1, including providing connecting means interconnecting the end portions of individual elements to each other.

7. A method according to claim 1, including providing a band connecting bottom elements to each other near the ground.

8. A method according to claim 1, including attaching the safety wall to fixed anchors by lines provided at the ends of the safety wall on the sides thereof facing away from the racetrack.

9. A safety wall for braking vehicles, in particular race car vehicles at the edge of a racetrack, which comprises: an elastic, one-piece safety wall.consisting essentially of elastic elements having essentially-corresponding dimensions and properties, wherein the one-piece safety wall elements are stacked horizontally and are laterally linked together fixedly to form said one-piece safety wall with chainlike mobility about an axis perpendicular to a roadway-surface to provide chain-like mobility of the safety wall, like that of an articulated belt, when struck by a vehicle, and wherein the entire one-piece safety wall can move in a chain-like manner relative to the ground when struck by a vehicle; wherein the elastic elements include end portions thereof and central portions thereof, and wherein the elastic elements are connected to each other adjacent the end portions thereof, contact each other adjacent the end portions thereof and are free from contact with each other at the central portions thereof.

10. A safety wall according to claim 9, including horizontally stacked tires as safety wall elements.

11. A safety wall according to claim 10, wherein individual safety wall elements are stacked in an intermeshed manner and are movably linked together at a plurality of points of contact therebetween.

12. A safety wall according to claim 9, including a band connecting bottom elements to each other near the ground.

13. A safety wall according to claim 9, including lines attaching the safety wall to fixed anchors provided at the ends of the safety wall on the sides thereof facing away from the racetrack.

14. A safety wall according to claim 9, having a length of 20 to 40 meters.

15. A safety wall according to claim 9, having a height of up to six tires.

16. A safety wall according to claim 9, wherein the safety wall elements are stacked and the stacks are movably linked together.

17. A safety wall according to claim 9, including connecting means interconnecting the end portions of individual elements to each other.

18. A safety wall according to claim 9, including horizontally stacked tires as safety wall elements.

19. A safety wall according to claim 9, wherein individual safety wall elements are stacked in an intermeshed manner and are movably linked together at a plurality of points of contact therebetween.

20. A safety wall according to claim 9, including a band connecting bottom elements to each other near the ground.

21. A safety wall according to claim 9, including lines attaching the safety wall to fixed anchors provided at the ends of the safety wall on the sides thereof facing away from the racetrack.

* * * * *